US006129526A

United States Patent [19]

Kelly

[11] Patent Number: 6,129,526

[45] Date of Patent: Oct. 10, 2000

[54] METERING PUMP HAVING A TUBULAR SEAL FOR SEALING A MAIN LIQUID FROM AN AUXILIARY LIQUID

[75] Inventor: Eddy Kelly, Quinsac, France

[73] Assignee: Societe DSA, Tresses, France

[21] Appl. No.: 09/101,239

[22] PCT Filed: Mar. 4, 1997

[86] PCT No.: PCT/FR97/00380

§ 371 Date: Jul. 6, 1998

§ 102(e) Date: Jul. 6, 1998

[87] PCT Pub. No.: WO97/33090

PCT Pub. Date: Sep. 12, 1997

[30] Foreign Application Priority Data

Mar. 7, 1996 [FR] France ..... 96 02874

[51] Int. Cl.[7] ..... F04B 17/00

[52] U.S. Cl. ..... 417/403; 417/521; 417/555.1

[58] Field of Search ..... 417/403, 409, 417/521, 553, 555.1

[56] References Cited

U.S. PATENT DOCUMENTS

| | | | |
|---|---|---|---|
| 4,436,494 | 3/1984 | Yamaizumi | 417/403 |
| 4,463,663 | 8/1984 | Hanson, Jr. et al. | 92/80 |
| 4,597,322 | 7/1986 | Garnjost et al. | 92/60 |
| 4,738,600 | 4/1988 | Safford | 417/403 |
| 4,756,329 | 7/1988 | Cloup | 137/99 |
| 4,809,731 | 3/1989 | Walton et al. | 137/99 |
| 5,055,008 | 10/1991 | Daniels et al. | 417/403 |
| 5,152,540 | 10/1992 | Kuze | 277/634 |
| 5,173,036 | 12/1992 | Fladby | 417/403 |
| 5,243,897 | 9/1993 | Walton et al. | 81/224 |
| 5,415,531 | 5/1995 | Cavanaugh | 417/397 |
| 5,505,224 | 4/1996 | Urrutia et al. | 137/99 |
| 5,513,963 | 5/1996 | Walton | 417/403 |

FOREIGN PATENT DOCUMENTS

| | | | |
|---|---|---|---|
| 2 329 980 | 5/1977 | France | G01F 11/02 |
| 2 333 944 | 7/1977 | France | F01B 31/26 |

*Primary Examiner*—Charles G. Freay
*Assistant Examiner*—Robert Z. Evora
*Attorney, Agent, or Firm*—Pollock, Vande Sande & Amernick

[57] ABSTRACT

A metering pump includes a motor compartment with a drive compartment defining a drive chamber. The drive chamber has an inlet and an outlet for a main liquid. A drive piston is moveably arranged in reciprocating translational motion in the drive chamber. A controller for controlling the movement of the drive piston under the action of the main liquid. A metering compartment defines a metering chamber. The metering chamber has an inlet and an outlet for an auxiliary liquid. The outlet for the metering chamber is separated from the outlet of the driving chamber. A metering piston is arranged in the metering chamber. The metering piston is driven by the drive piston. A frustoconical sealing member is arranged with its small base facing the drive compartment. An extension of the metering piston has a diameter smaller than a body of the metering piston. The extension and the frustoconical sealing member form a suction valve. A suction-delivery portion is arranged on the metering piston. An extendable tubular element has a first end sealingly fastened to a tubular part that is fixed to the drive chamber. The metering chamber is connected to the drive chamber via the tubular part. A second end of the extendable tubular element is sealingly fastened to the metering piston, wherein a flow of the auxiliary liquid supplied by the metering compartment is substantially proportional to a flow of the main liquid.

9 Claims, 2 Drawing Sheets

METERING PUMP HAVING A TUBULAR SEAL FOR SEALING A MAIN LIQUID FROM AN AUXILIARY LIQUID

CROSS-REFERENCE TO RELATED APPLICATIONS

This application is a 371 of PCT/FR97/00380 filed on Mar. 4, 1997.

FIELD OF THE INVENTION

The invention relates to improvements to metering pumps of the type comprising:

a drive compartment comprising a drive piston movable in reciprocating translational motion in a drive chamber having an inlet and an outlet for main liquid, and means for controlling the movements of the piston under the action of the main liquid, a metering compartment comprising a metering piston in a metering chamber connected to the drive chamber and having an inlet for auxiliary liquid, the metering piston being driven in reciprocating translational motion by the drive piston and being equipped with suction/delivery means, the assembly being such that the flow of auxiliary liquid supplied by the metering compartment is proportional or substantially proportional to the flow of main liquid.

BACKGROUND OF THE INVENTION

Metering pumps of this type are known, particularly from EP-A-0,255,791 or from FR-B-2,707,350. These pumps are especially useful for injecting an additive, consisting of the auxiliary liquid, into the main liquid which serves at the same time as drive fluid. Such metering pumps have many uses. They make it possible, for example, to carry out a metering of chlorine (auxiliary liquid) into water (main liquid) or a metering of a drug for cattle into the water of a drinking trough or else to prepare beverages based on water (main liquid) and concentrate (fruit juice concentrate or tea concentrate) forming the auxiliary liquid.

For some uses, such as the metering of chlorine into water or of drugs for cattle into water, the proportion of auxiliary product to be added to the main liquid is low; it is relatively difficult to maintain this proportion exactly, particularly on account of leaks, albeit very slights, when a conventional seal is used, through which a rod slides, for example a connecting rod between the drive piston and the metering piston; such a seal does not make it possible to prevent tiny quantities of liquid on either side of the seal from being carried along due to capillary action.

Metering accuracy is therefore impaired by these, albeit very small, leaks.

In addition to the metering inaccuracy, these leaks eventually lead to various other problems, for example to scale being deposited on the rod, when chlorine is metered into hard water, or to the growth of bacteria, when a sweetened concentrated beverage (auxiliary liquid) is metered into water (main liquid).

These problems only become more serious during operation, since friction causes irreparable wear of the seal, which is accompanied by an increase in the passage of liquid on either side of the seal.

SUMMARY OF THE INVENTION

The object of the invention is, to provide a metering pump of the type defined above, which no longer has the above-mentioned disadvantages.

According to the invention, a metering pump of the type defined above, in which the metering chamber comprises its own outlet orifice separated from that of the drive chamber, is characterized in that the metering chamber is isolated from the drive chamber by an extendable tubular element, one end of which is sealingly fastened to a part fixed to the drive chamber and the other end of which is sealingly fastened to the metering piston.

Preferably, the extendable tubular element is produced from a material suitable for withstanding the variations in pressure of the auxiliary liquid and main liquid in the metering and drive chambers, so as to prevent any variation in the volume of the metering chamber other than that attributable to the displacement of the metering piston. Metering accuracy is thus ensured.

Such material for the tubular element consists especially of a suitable plastic, in particular polypropylene.

The extendable tubular element is advantageously formed by a kind of sheath, of which the end fastened to the drive chamber comprises an outer peripheral bead sealingly clamped between a bearing surface of a tubular part fixed to the drive chamber and a clamping element fastened to this part, especially by screwing. The other end of the sheath comprises an inner radial collar, through which passes a central hole, this collar being blocked against the metering piston by clamping between one end of this metering piston and a bearing element fixed to a driving rod of the drive piston, the rod comprising a threaded end which passes through the washer and which is screwed into the metering piston.

The sheath extendability which ensures sealing is advantageously obtained by means of folds on the cylindrical part of this sheath, so as to bring about longitudinal extendability as a result of the opening of the folds.

The longitudinal section of the sheath is zigzag-shaped, and the peaks of the zigzag are designed to form hinges for easy opening and closing, the faces of the sheath which extend between two peaks of the zigzag are sufficiently rigid to avoid being deformed under pressure. Advantageously, in the case of a sheath produced in one piece from the same material, the peaks of the zigzag have a smaller thickness than the faces.

BRIEF DESCRIPTION OF THE DRAWINGS

Apart from the arrangements explained above, the invention consists of some other arrangements which will be discussed more explicitly below with regard to particular exemplary embodiments which are described with reference to the accompanying drawings, but which are in no way limiting and in which.

DETAILED DESCRIPTION OF THE INVENTION

Figure 1:
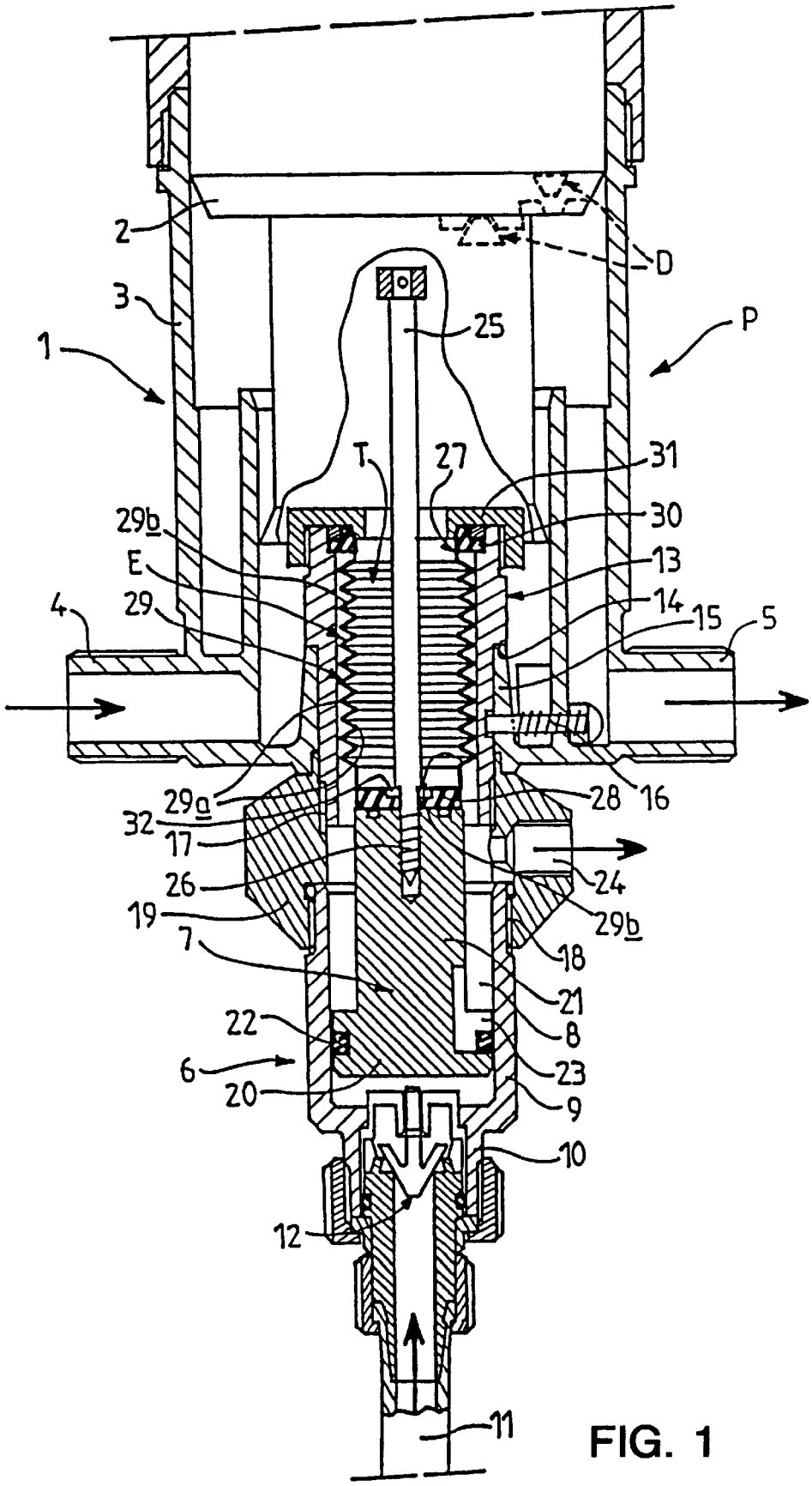
FIG. 1 is a diagrammatic vertical axial section through a metering pump according to the invention.

Referring to FIG. 1 of the drawings, a metering pump P, or proportional metering device, can be seen, comprising a drive compartment 1 with a piston 2 movable in reciprocating translational motion in a drive chamber 3. In the example illustrated, the piston 2 is of the differential type, but it could be of another type. The chamber 3 comprises an inlet orifice 4 and an outlet orifice 5 for main liquid. The chamber 3 is closed in the upper part by means of a cap not shown.

Distribution means D are provided for controlling the reciprocating movements of the piston under the action of the main liquid entering via the orifice 4. These distribution means D, known, for example, from EP-A-0,255,791 or FR-B-2,707,350, are shown only highly diagrammatically and will not be described in detail. It is merely recalled that these means D may tilt from a first to a second position and vice versa. The means D make it possible, in the first position, to displace the piston 2 in the direction moving it away from the inlet orifice 4, with main liquid being admitted into the chamber 1, and, in the second position, to displace the piston 2 in the opposite direction, with a specific volume of main liquid being delivered via the outlet orifice 5. The reversal of the distribution means D is controlled mechanically at the end of each outward or return stroke of the piston 2.

The metering pump P also comprises a metering compartment 6 with a metering piston 7 movable in reciprocating translational motion in a metering chamber 8 coaxial to the drive chamber 1.

The metering chamber 8 is delimited by a cylindrical wall 9 provided, at its lower end, with a nipple 10, to which a pipe 11 for the suction of the auxiliary product is connected. The pipe 11 is submerged with its lower end, not shown, in a receptacle containing the auxiliary liquid. A suction valve 12 is mounted in the nipple 10. The valve 12 is designed to open when the metering piston 7 moves away from the nipple 10 and sucks in liquid, while the valve 12 closes when the piston 7 approaches the nipple 10.

The cylindrical wall 9 is fastened coaxially to a tubular part 13 open at its two axial ends, this part 13 being fixed to the drive chamber 3. The part 13 forms a kind of cylindrical sleeve comprising on its outer wall, in the upper part, a shoulder 14 which comes into axial abutment against the upper end of a seat 15 provided in the bottom of the chamber 3. The part 13 can be blocked in terms of axial translational motion on the seat 15 by means of a screw 16 which is oriented transversely to the axis of the seat 15 and the inner end of which is engaged in a recess provided on the surface of the part 13.

The lower end of the part 13 projects beyond the base of the chamber 3 and is preferably provided with a thread 17 on its outer surface. The wall 9 is provided with a thread 18 in the upper part of its outer surface. The wall 9 and the part 13 are assembled with the aid of an internally threaded intermediate sleeve 19; the inner volume of the cylindrical wall 9 communicates with the inner space of the part 13.

The metering piston 7 comprises a head 20, the outside diameter of which is equal to the diameter of the bore of the wall 9, and a piston body 21 of smaller diameter, extending from the head 20 toward the drive chamber 3. The head 20 is equipped with a suction/delivery means 22. This means 22 includes of an annular seal, for example of square section, arranged in a peripheral groove of the head 20.

The piston 7 comprises a recess 23 extending parallel to its axial direction from the groove, in which the seal/valve 22 is accommodated, on the opposite side to the suction valve 12. This recess 23 has an angular extent sufficient to impart some freedom of movement to that part of the seal 22 which is located in the recess 23.

Under these conditions, when the piston 7 is displaced upward according to the figure, the seal 22 is laid against the lower transverse face of the groove forming its receptacle and maintains sealing between the two spaces located on either side of the head 20. Auxiliary liquid is sucked into the lower space located below the head 20, in the chamber 8. By contrast, during the descending movement of the piston 20, when the valve 12 has closed, the seal 22 in the part of the recess 23 will rise and allow auxiliary liquid to pass from the lower space to the space located above the head 20 of the piston 7.

The metering chamber 8 has its own outlet orifice 24 separated from the outlet orifice 5 of the drive chamber. If the auxiliary liquid is an additive product to be mixed with the main liquid, mixing may take place downstream of the pump P by joining together the conduits connected respectively to the orifices 5 and 24.

The body 21 of the piston 7 is connected by a rod 25 to the differential drive piston 2 which controls the displacements of the metering piston 7. The lower end 26 of the rod 25 is threaded and is screwed into a coaxial internally threaded hole in the upper end of the piston body 21.

The metering chamber 8 is isolated from the drive chamber 3 by full-sealing sealing means E which comprise an extendable tubular element T, one end 27 of which, namely the upper end according to the drawing, is sealingly fastened to the part 13 fixed to the drive chamber 3 and the other end 28 of which is sealingly fastened to the metering piston 7.

The extendable tubular element T advantageously comprises an extendable sheath 29 produced from a material sufficiently rigid to withstand the external or internal hydraulic pressure. The extendability of the sheath 29 is obtained by folding the cylindrical part of this sheath, so as to produce a zigzag-shaped profile capable of being unfolded longitudinally in the direction of the axis of the tube T by virtue of the hinges or joints formed by the peaks 29*a* of the profile. However, the material of the sheath is sufficiently rigid to ensure that those faces 29*b* of the folds which are contained between two peaks 29*a* are not appreciably deformed under the effect of the hydraulic pressure. Metering is therefore not impaired by variations in volume of the metering chamber 8 other than those attributable to the displacement of the piston 7.

As regards a sheath 29 produced in one piece from the same material, the joint flexibility of the peaks 29*a* may be obtained by means of a smaller thickness than that of the faces 29*b*.

The sheath 29 is preferably produced from a plastic, in particular polypropylene.

The upper end 27 of the sheath 29 forms an outer bead 30 clamped in an annular receptacle of the part 13, against a shoulder of this part, by a cap 31 having a central aperture for the passage of the rod 25, with a washer being interposed. The cap 31 is provided externally with a cylindrical rim having an internal thread capable of being screwed onto an external thread of the upper end of the part 13. The lower end 28 of the sheath 29 includes a collar projecting radially inward and provided with a central hole for the passage of the end 26 of the rod 25. This collar is sealingly clamped between the transverse end of the body 21 of the piston 7 and a disk 32 fixed to the rod 25.

The assembly is designed in such a way that the stroke of the head 20 of the piston 7 takes place solely within the bore of the cylindrical wall 9.

This being so, the metering pump functions as follows.

The reciprocating translational movements of the differential drive piston 2 are transmitted to the metering piston 7 by the rod 25.

When this piston 7 executes an ascending stroke (according to the drawing), auxiliary liquid from the chamber 8 is delivered via the outlet 24, while auxiliary liquid coming from the pipe 11 is sucked through the valve 12 into the space located below the head 20.

During the descent of the piston 7, as explained above, the seal/valve 22 executes a movement allowing auxiliary liquid to pass from the space located under the piston head 20 to the space located above this head, when the valve 12 is closed.

The extendable tubular element T ensures full sealing, in such a way that the problems mentioned above, such as scale being deposited on the rod 25, when chlorine is metered into hard water, or the growth of bacteria, when the main liquid is water and the auxiliary liquid is a sweetened concentrated beverage, no longer exist.

Metering accuracy is ensured, in particular, as a result of the sufficient rigidity of the material forming the folded sheath T and withstanding the hydraulic pressure.

There is no longer any friction between the extendable tubular sealing element T and the connecting rod 25.

Figure 2:
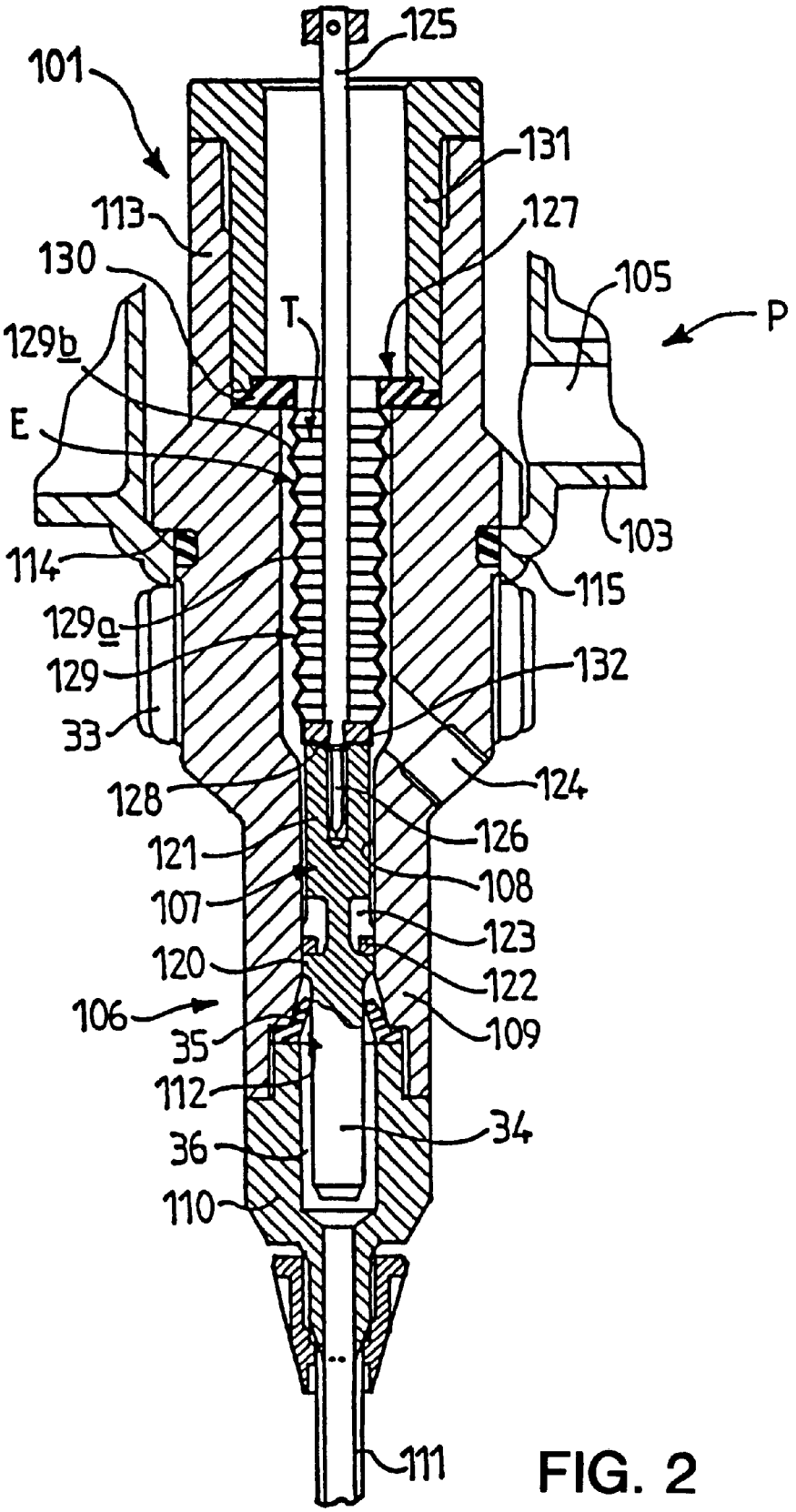
FIG. 2 is a partial diagrammatic vertical section through an alternative embodiment of the metering device of FIG. 1.

Referring to FIG. 2 of the drawings, an alternative embodiment of the metering pump according to the invention can be seen. Elements of this alternative which are similar to elements already described with regard to FIG. 1 or perform the same functions are designated by reference numerals equal to the sum of the number 100 and the reference number used in FIG. 1. The description of these elements will not be repeated or will be given only briefly.

The cylindrical wall 109 and the tubular part 113 form one part which must be engaged from above (according to the illustration in FIG. 2) through the orifice delimited by the seat 115, against which a shoulder 114 of the part 113 comes to bear axially. This part 113 comprises, on a region of its outer surface located below the seat 115 when the assembly is in place, a thread, onto which can be screwed a nut 33 which makes it possible to block all the parts 109 and 113 on the drive chamber 103.

The metering piston 107 has a head 120 of a diameter slightly greater than that of the body 121. The relative difference between the diameter of this head and that of the body 121 is less marked than in the example of FIG. 1.

The metering piston 107 comprises, at its end remote from the drive compartment 101, an extension 34 of smaller diameter than the body 121. This coaxial extension 34 passes through a flexible frustoconical sealing member 35 in order to penetrate into a cylindrical space 36 having a diameter greater than that of the extension 34. This space 36 is located in the nipple 110. The axial length of the extension 34 is greater than the stroke of the piston 107, so that the extension 34 always passes through the frustoconical member 35. The small base of this sealing member 35, produced, for example, from elastomeric material, faces the drive compartment 101, while its large base comprises a collar projecting radially outward and clamped between a shoulder of the cylindrical wall 109 and another shoulder of the nipple 110.

When the piston 107 rises according to FIG. 2, the frustoconical member 35 tends to open and allow auxiliary liquid sucked in by the metering piston 107 and its extension 34 to pass. During the descent of the piston 107, the frustoconical member 35 tends to be laid sealingly against the extension 34 and prevents any flow of liquid from the metering chamber 108 toward the space 36.

The combination of the extension 34 and of the sealing member 35 constitutes a suction means 112 equivalent to the valve 12 of FIG. 1.

The overall functioning of the metering pump of FIG. 2 is similar to that described with regard to FIG. 1.

The use of an unrolling diaphragm instead of the folded tubular sheath would make it possible to ensure sealing, but would present problems due to the relatively long strokes of the metering pumps and would lead to a metering error because a diaphragm does not have sufficient rigidity to withstand the hydraulic pressure and is deformed in the manner of a bladder.

A simple concertina made of elastomeric material and easy to produce by hardening would give rise to the same problems as the diaphragm mentioned above.

The solution of the unrolling diaphragm or of the concertina made of elastomeric material may be appropriate if the only aim is sealing, without the further requirement of high metering accuracy.

What is claimed is:

1. A metering pump comprising:

a drive compartment defining a drive chamber, the drive chamber having an inlet and an outlet for a main liquid;

a drive piston moveably arranged in reciprocating translational motion in the drive chamber;

distribution means controlling movement on the drive piston under action of the main liquid;

a metering compartment defining a metering chamber, the metering chamber having an inlet and an outlet for an auxiliary liquid, the outlet for the metering chamber being separated from the outlet of the driving chamber;

a metering piston arranged in the metering chamber, the metering piston being driven by the drive piston;

a frustoconical sealing member arranged with its small base facing the drive compartment, an extension of the metering piston, having a diameter smaller than a body of the metering piston, passing through the frustoconical sealing member, the extension and the frustoconical sealing member forming a suction valve;

suction-delivery means arranged on the metering piston; and an extendable tubular element having a first end sealingly fastened to a tubular part that is fixed to the drive chamber, the metering chamber being connected to the drive chamber via the tubular part, a second end of the extendable tubular element sealingly fastened to the metering piston, wherein a flow of the auxiliary liquid is supplied by the metering compartment substantially proportional to a flow of the main liquid.

2. Metering pump according to claim 1, wherein the extendable tubular element is formed from a material suitable for withstanding the variations in pressure of the auxiliary liquid and main liquid in the metering and drive chambers, so as to prevent any variation in the volume of the metering chamber other than that attributable to the displacement of the metering piston.

3. Metering pump according to claim 1, wherein the material of the tubular element consists of a plastic.

4. Metering pump according to claim 3, wherein the plastic is polypropylene.

5. Metering pump according to claim 1, wherein the extendable tubular element is formed by a sheath, an end of the sheath is fastened to the drive chamber and comprises an outer peripheral bead sealingly clamped between a bearing surface of the tubular part fixed to the drive chamber and a clamping element fastened to the tubular part, a second end of the sheath comprises an inner radial collar, through which passes a central hole, the collar being blocked against the metering piston by clamping between one end of the metering piston and a bearing element fixed to a driving rod of the drive piston, the driving rod comprising a threaded end screwed into the metering piston.

6. Metering pump according to claim 1, wherein the extendable tubular element comprises a sheath, the sheath having folds on its cylindrical part, longitudinal extendability of the sheath is provided as a result of the opening of the folds.

7. Metering pump according to claim 6, wherein a longitudinal section of the sheath is zigzag-shaped, and peaks of the zigzag form hinges with easy opening and closing, while faces of the sheath which extend between two peaks of the zigzag-shape are sufficiently rigid to avoid being deformed under pressure.

8. Metering pump according to claim 7, wherein the sheath is produced in one piece.

9. Metering pump according to claim 8, wherein the peaks of the zigzag have a smaller thickness than the faces.

* * * * *